US006347835B1

(12) United States Patent
LaPointe et al.

(10) Patent No.: US 6,347,835 B1
(45) Date of Patent: Feb. 19, 2002

(54) RECLINING CHAIR HAVING ADJUSTABLE CHAIR FRAME

(75) Inventors: Larry P. LaPointe, Temperance; Michael R. Mero, Jr., Monroe, both of MI (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

(21) Appl. No.: 09/543,256

(22) Filed: Apr. 5, 2000

(51) Int. Cl.[7] ..... A47C 7/00
(52) U.S. Cl. ..... 297/440.1; 297/440.15
(58) Field of Search ..... 297/440.1, 440.15, 297/440.22

(56) References Cited

U.S. PATENT DOCUMENTS 4,148,106 A * 4/1979 Gallien ..... 297/440.1 X
5,184,871 A 2/1993 LaPointe et al.
5,288,126 A * 2/1994 Saul et al. ..... 297/440.1
5,423,591 A 6/1995 LaPointe et al.
5,518,298 A * 5/1996 LaPointe et al. ..... 297/440.1 X
5,984,417 A * 11/1999 Wang ..... 297/440.1
6,217,120 B1 * 4/2001 Pugliese ..... 297/440.1

* cited by examiner

*Primary Examiner*—Anthony D. Barfield
(74) *Attorney, Agent, or Firm*—Harness, Dickey & Pierce, P.L.C.

(57) ABSTRACT

The present invention provides an adjustable frame member for a chair seat frame and a lockable alignment tool which is implemented between the chair seat frame and an attachable seat back. Initially, the chair seat frame is pre-assembled such that the adjustable frame member is in a non-rigid state, therefore allowing for side to side skewing motion of the chair seat frame. The lockable alignment tool is mounted onto the seat back, in its unlocked position. Once the lockable alignment tool is mounted to the seat back, it is locked such that its length is fixed. The lockable alignment tool is then removed from the seat back and mounted onto the seat frame. As the lockable alignment tool is mounted onto the seat frame, skewing motion of the seat frame is caused as the seat frame aligns with the lockable alignment tool. Once the lockable alignment tool has been fully mounted to the chair frame, screws are used to lock the adjustable frame member. As such, the adjustable frame member becomes a rigid structure. The lockable alignment tool is then removed and overall assembly may be completed with proper alignment between the chair seat frame and back ensured.

4 Claims, 5 Drawing Sheets

68
78
66
76
74
10
76
70
74
18
24b
16
24a
12
X1
22
14
64
X3
72
X2
28b
62
32b
28a
60
30a
32a
30b
16
X4
26
20

FIG 2
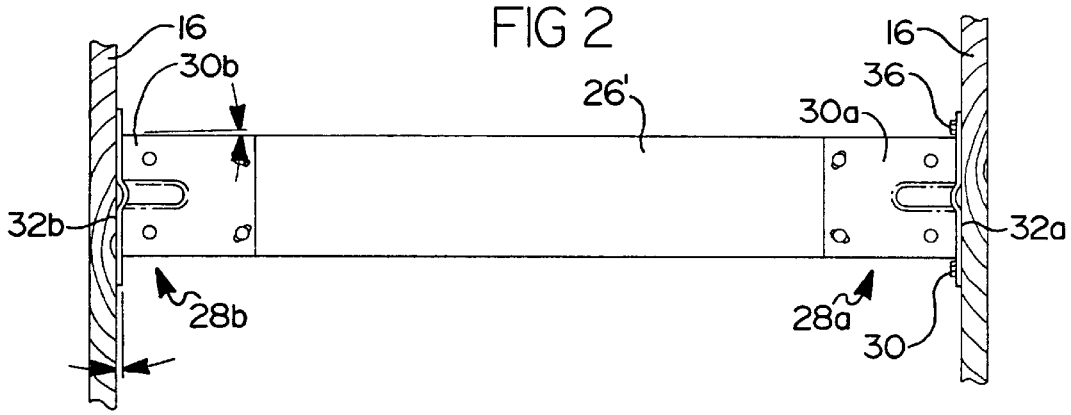
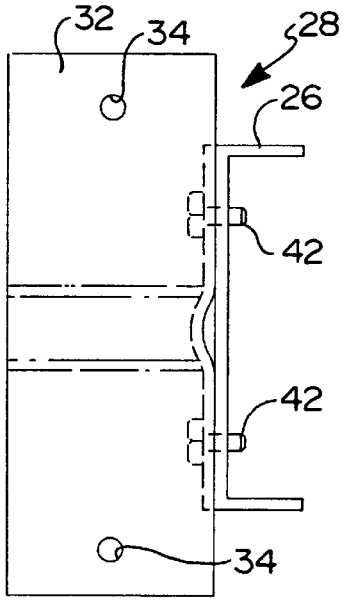
FIG 3A
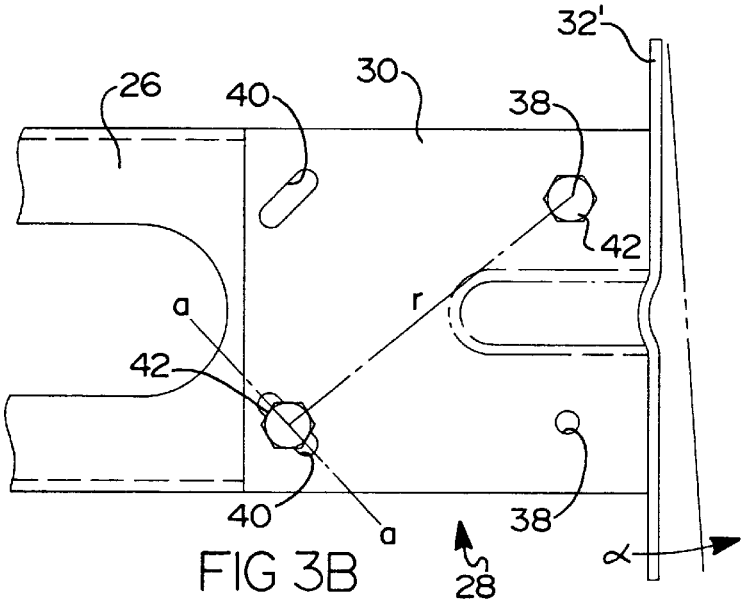
FIG 3B
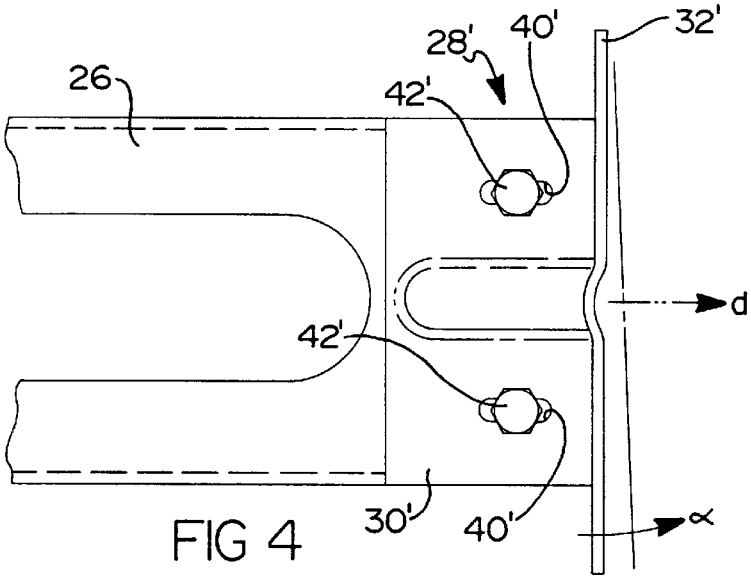
FIG 4

FIG 8A
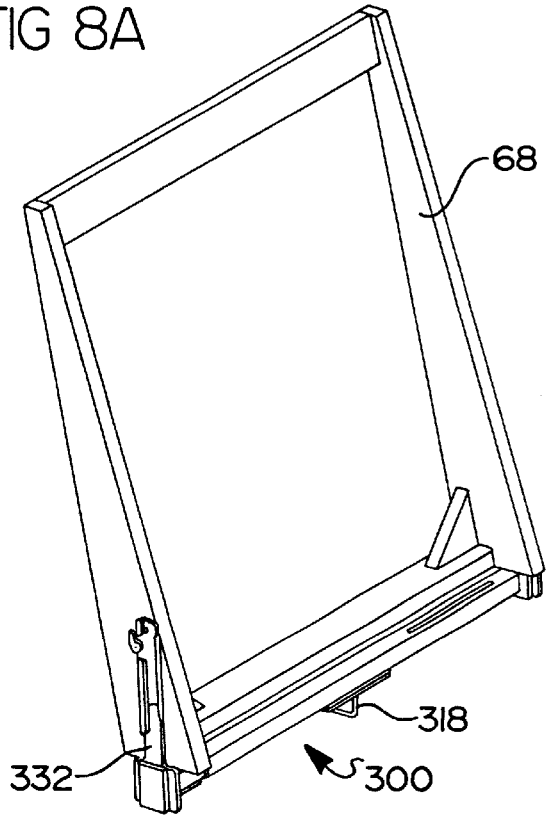
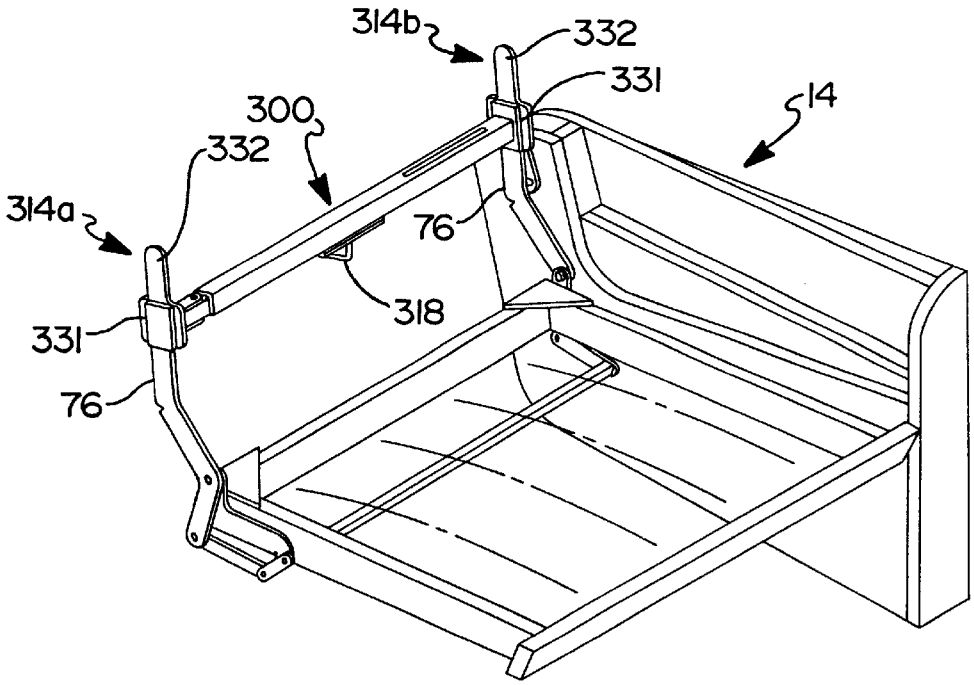
FIG 8B

RECLINING CHAIR HAVING ADJUSTABLE CHAIR FRAME

BACKGROUND OF THE INVENTION

1. Technical Field

The present invention relates generally to reclining chairs, and more particularly, to an improved apparatus and method for assembling a reclining chair from pre-fabricated modular components.

2. Description of Related Art

It is conventional in the furniture industry to install detachable seat back members on chairs, sofas and the like to facilitate more efficient storage in shipment. More particularly, detachable seat backs are primarily used on motion furniture such as reclining-type chairs which may have high seat back members. One example of a reclining chair having a detachable seat back is disclosed in U.S. Pat. No. 3,525,549 which illustrates the use of slide brackets mounted on each side of the seat back that are insertable over upstanding swing links mounted on opposite sides of the chair. In addition, U.S. Pat. No. 4,082,355 discloses a similar locking mechanism for detachably securing a seat back to a seating unit of an upholstered sofa.

Traditionally, the chair frame which maintains the swing links on opposite sides of the base, were manufactured separately from the seat back which maintains the slide brackets on either side of the seat back. Upon assembly of the chair frame, it was noticed that considerable variation in the alignment of the structural components existed. In extreme situations, the side panels could be sufficiently out of square such that the chair frame would hit the rocker base or the rocker lockout mechanism would become disengaged. Additionally, it was noticed that the seat back was not easily attached to the reclining mechanism. Therefore, it is desirable in the industry to have an apparatus and method for properly aligning the chair frame during assembly, thereby allowing for accurate and easy assembly.

SUMMARY OF THE INVENTION

It is a primary object of the present invention to provide an improved apparatus and method of assembling a reclining chair from prefabricated modular components.

It is another object of the present invention to provide an adjustable frame member which may be adjusted during assembly to ensure proper alignment between frame components.

Additionally, it is an object of the present invention to provide tooling fixtures to ensure proper alignment and correct adjustment of the frame components.

A preferred embodiment of the present invention is a reclining chair which is adapted to permit selective and independent "reclining" movement of a seat back relative to a seat member as well as actuation of a leg rest assembly. As such, the present invention provides a reclining chair wherein the minimal force achieved via shifting the weight of the seat occupant is utilized as the primary means for moving the seat assembly between an "upright" position and a "reclined" position.

In the preferred embodiment of the present invention, the integrated or "knock-down" construction of the reclining chair facilitates application of unique fabrication and assembly techniques which effectively results in increased production efficiency and cost savings while concomitantly producing a high-quality article of furniture. In general, the construction of the reclining chair is such that the prefabricated actuation mechanism is integral with the prefabricated frame components which, when assembled, are rigidly interconnected to define a "box-like" chair frame or body. The "box-like" chair frame or body of the reclining chair supports a swing link mechanism on either side of the chair frame, a portion of which is inserted into the seat back structure. As such, precise alignment between the swing link mechanism and the seat back is required.

To achieve this alignment, the present invention introduces an adjustable frame member and a method of assembly. The adjustable frame member is comprised of a pair of connection brackets disposed on opposite ends of an inter-linking frame piece. During assembly of the "box-like" chair frame, the adjustable frame member of the present invention is affixed to both the left and right arm portions via the connection brackets. Initially, the inter-linking frame member is loosely fastened to the connection brackets, using a single screw. The side panels, being assembled as such, are not rigid and may be skewed or out of square with respect to one another.

To properly align the prefabricated chair frame and the prefabricated chair back, the components are assembled on an assembly table which precisely positions the side panels in the proper orientation for providing a square and true chair frame. The various components of the reclining chair are assembled and secured to the side panels. Upon final fabrication of the chair frame, the rear adjustable frame member is securely fastened to the side panels such that a true and square chair frame is provided.

In this manner, it has been found that an accurate measurement of the chair frame is achieved through a comparison of the diagonal measurements taken from the upper front corner to the lower rear corner of the chair frame. Once the adjustable frame rail has been secured, the chair frame may be removed from the assembly table and final assembly may be completed. The assembly process being performed as such, allows for proper alignment between the chair back frame and its components. Therefore, the remainder of the chair assembly, including upholstery, etc., may proceed in a standard manner. Having used this alignment step during the assembly process, the final, completed chair components are properly aligned and thus may be easily assembled.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

FIG. 2 is a detailed view of a first preferred embodiment of an adjustable frame member according to the principles of the present invention;

FIGS. 3A and 3B are detailed views of a connection bracket illustrated in FIG. 2;

FIG. 4 is a detailed view of a second preferred embodiment of an adjustable frame member according to the principles of the present invention;

FIGS. 8A and 8B are perspective views of reclining chair modular components, detailing the implementation of an alignment tool according to the principles of the present invention.

DETAILED DESCRIPTION OF THE PREFERRED EMBODIMENTS

In the disclosed embodiments, the article of furniture is shown as a combination recliner and platform rocker, hereinafter referred to reclining/rocking chair 10, which includes a prefabricated actuation mechanism 12 and various upholstered frame components that can be quickly and simply modularly assembled as a seating unit. Such "modular" construction provides a significant advancement over conventional furniture fabrication and assembly techniques since manipulation of heavy and cumbersome chair frames during upholstery installation is no longer required. As such, the frame components can be upholstered prior to modular assembly to actuation mechanism 12 so as to improve individual component quality, as well as overall system quality and production efficiency. Alternatively, the frame components can be adapted to accept upholstered trim panels following modular assembly. Moreover, since actuation mechanism 12 of the present invention is relatively compact in size, the use of loose upholstered cushions, which is an important feature in marketing various styles of chairs, sofa, or loveseat furniture, is also possible.

Figure 1:
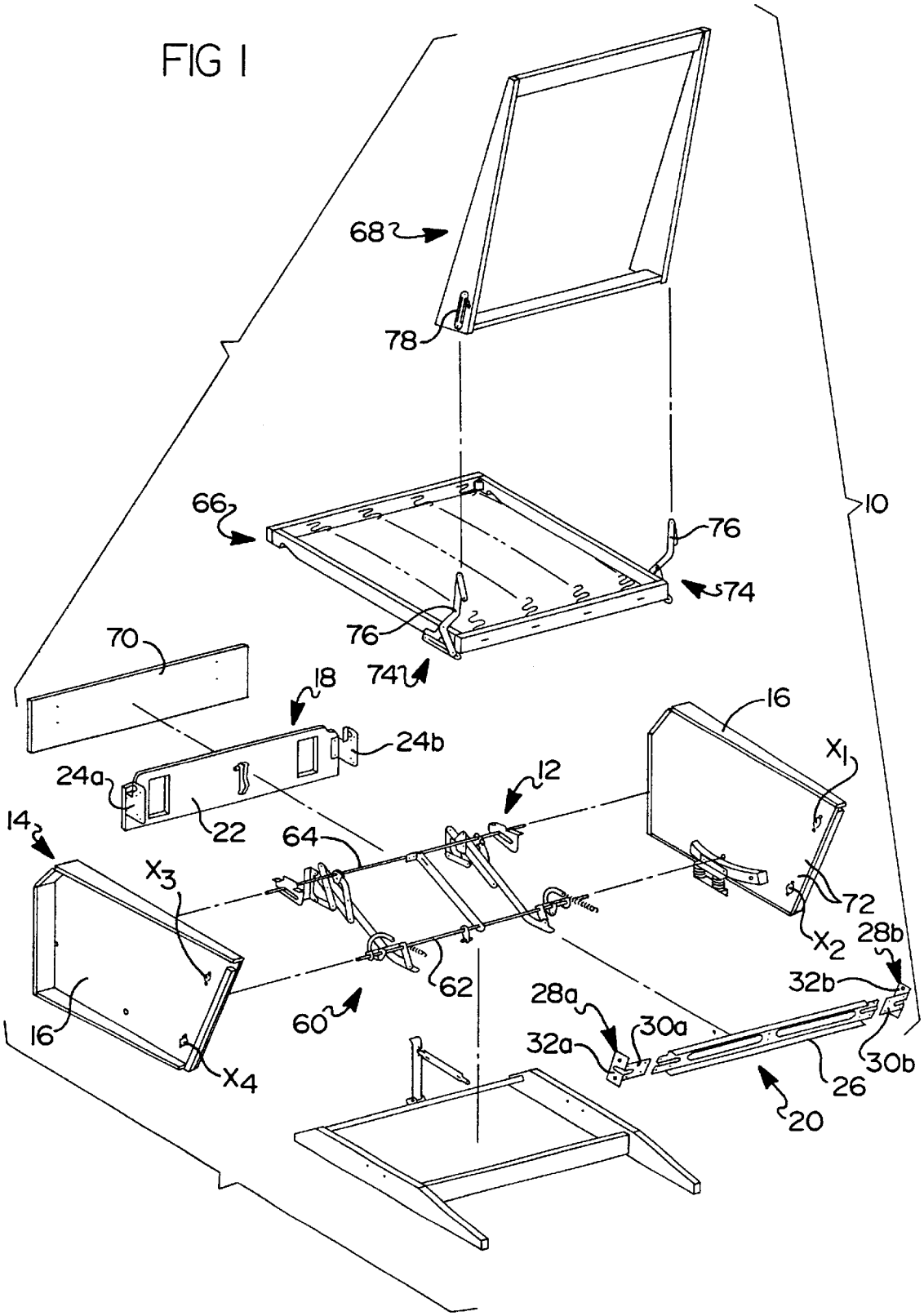
FIG. 1 is an exploded perspective view of a reclining chair with upholstery springs and other parts removed from the frame components for illustrating their integrated interdependent association with an adjustable frame member.

With particular reference now to the drawings, the adjustable frame structure and the improved assembly method will now be described. For purposes of clarity, FIG. 1 shows the various prefabricated frame components with their upholstery, padding, springs, etc. removed to better illustrate the interdependency of the frame component's construction which can be rapidly and rigidly assembled in a relatively easy and efficient manner. Therefore, all of the frame components can be individually fabricated or sub-assembled to include the requisite brackets, springs, padding and upholstery on an "off-line" batch type basis. Thereafter, the various pre-assembled frame components are modularly assembled for totally integrating actuation mechanism 12 therein.

Actuation mechanism 12 of reclining/rocking chair 10 is integrated into and operably suspended from chair frame 14 which includes left and right side panel 16 and front and rear frame rail members 18 and 20, respectively. The front frame rail 18 includes an inter-linking front frame rail 22 and a pair of front connection brackets 24*a*, 24*b* rigidly secured to side panels 16 with fasteners. The rear frame rail 20 includes an inter-linking rear frame rail 26 and a pair of first connection brackets 28*a*, 28*b* rigidly secured to side panels 16. It will be appreciated that inter-linking frame rail 26 can be made of either a stamped metal sheet as shown in FIGS. 1, 3A and 3B or a generally rectangular shaped wooden member as shown in FIG. 2. With specific reference to FIGS. 2, 3A and 3B, connection bracket 28 includes transverse flange 30 secured to inter-linking rail 26 and longitudinal flange 32 secured to side panel 16. Connection bracket 28 is generally L-shaped in that transverse flange 30 is substantially perpendicular to longitudinal flange 32. However, one skilled in the art will readily recognize that the angle between transverse flange 30 and longitudinal flange 32 may be slightly greater than 90° to accommodate the width of chair frame 14 which tapers inwardly from the front to the rear of chair 10.

With specific reference now to FIG. 3A, longitudinal flange 32 has a pair of apertures 34 extending therethrough which are adapted to receive threaded fasteners 36 (shown in FIG. 2) for securing connection bracket 28 to side panel 16. As shown in FIG. 3B, transverse flange 30 has a pair of apertures 38 formed therethrough adjacent longitudinal flange 32 and a pair of elongated slots 40 formed therethrough for receiving threaded fasteners 42 which secure connection bracket 28 to inter-linking rail 26. As best seen in FIG. 3B, elongated slots 40 are oriented in a manner such that bracket 28 is permitted to pivot about an axis defined by aperture 38, thereby providing angular adjustment indicated by the angle a shown in FIG. 3B. More specifically, elongated slots 40 are tangentially arranged on an axis a—a which is perpendicular to a radius extending from aperture 38 at a distance r shown in FIG. 3B. Furthermore, brackets 28 are configured in a universal manner such that the same bracket may be used on either the right side or the left side.

With reference now to FIG. 4, a second preferred embodiment of the rear frame rail 26' is illustrated which includes transverse flange 30' and longitudinal flange 32'. Connection bracket 28' is substantially similar to connection bracket 28 with the exception that transverse flange includes a pair of horizontally-oriented elongated slots 40' which are adapted to receive threaded fasteners 42' for securing connection bracket 28' to inter-linking rail 26. In this manner, connection bracket 28' is laterally positionable in the direction d with respect to inter-linking rail 26 and angularly positionable in the direction a with respect to inter-linking rail 26.

Figure 5:
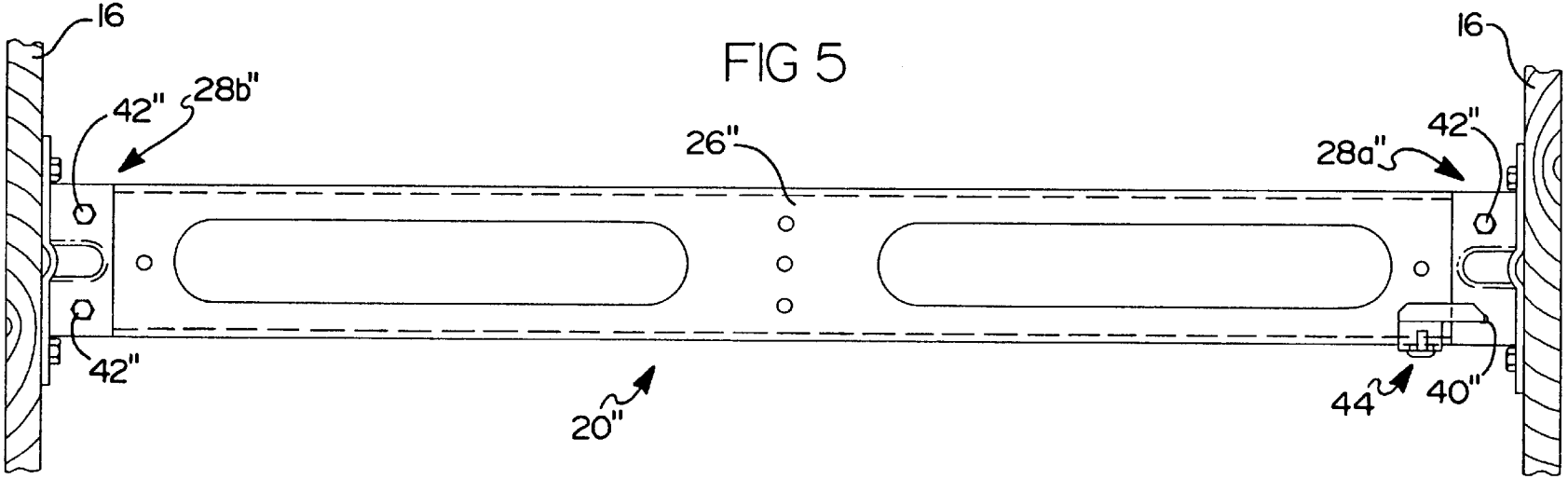
FIG. 5 is a detailed view of a third preferred embodiment of an adjustable frame member according to the principles of the present invention.
Figure 6:
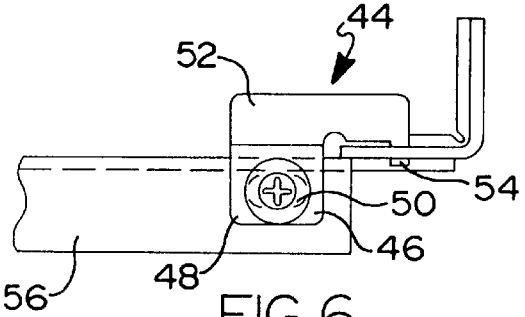
FIG. 6 is a detailed view of a connection bracket illustrated in FIG. 5.

With reference now to FIGS. 5 and 6, a third preferred embodiment of the rear frame rail assembly in accordance with the present invention is illustrated and will be described. Rear frame rail assembly 20" includes interconnecting rail 26", connection brackets 28" and interconnection link 44. Connection brackets 28" are similar to connection brackets 28' with the exception that elongated slots 40' are replaced by circular apertures 40" which receive threaded fasteners 42" for securing connection brackets 28" to inter-linking frame rail 26". Interconnection link 44 operably couples inter-linking frame rail 26" with connection bracket 28" to permit relative angular movement therebetween. More specifically, interconnection link 44 includes a flange portion 46 having an elongated slot 48 formed therethrough. Threaded fastener 50 is received within elongated slot 48 for releasably coupling interconnecting link 44 with inter-linking frame member 26". Interconnecting link 44 further includes extension 52 having finger 54 extending therefrom which is adapted to be positioned within a throughbore 40" of connection bracket 28". While rear frame rail 20" has been illustrated as having an interconnection link 44 operably disposed on the right hand connection bracket 28*a*", one skilled in the art will readily recognize that either side or both sides of rear frame rail 20" may be provided with interconnecting link 44 depending upon the degree of adjustability needed.

Interconnecting link 44 is attached to inter-linking rail 26" by screw 50. Initially, screw 50 is loosened such that link 44 is free to slide or otherwise move about screw 50. Similarly, since connection bracket 28" is attached to inter-linking rail member 26" via a screw 42", connection bracket 28" is pivotable about screw 42". This provides a degree of freedom for allowing adjustment of side panels 16 with respect to one another. Once an appropriate relative position has been achieved, threaded fastener 50 may be tightened to fixedly secure connection bracket 28" with respect to inter-linking frame rail 26".

It is important to note that, according to the third preferred embodiment, the locking feature, namely screw 50, is located on a bottom flange 56 of inter-linking frame rail 26". As such, it is possible to access screw 50 and adjust side panels 16 from below chair frame 10. As a result, the adjustment of side panels 16 may be achieved without requiring removal of additional upholstery panels or other finished appearance surfaces.

With reference again to FIG. 1, chair frame 10 is shown to support leg rest assembly 60 thereon. More specifically, leg rest assembly 60 is operably associated with drive rod 62 and front support shaft 64 for permitting the seat occupant to selectively actuate leg rest assembly 60. In the preferred construction, drive rod 30 is an elongated square shaft having a handle portion (not shown) provided adjacent an upholstered exterior portion of one of side panels 16 that can be easily reached by a person seated in chair 10 for convenient actuation thereof.

Most of the structural frame components such as side panels 16, front frame rail 18, rear frame rail 20, seat frame 66, seat back frame 68 and leg rest frame board 70 are each fabricated and/or constructed in a manner which enables them to support springs, padding, upholstery, etc. in order to complete a decorative and stylish reclining/rocking chair 10. The various frame components can be individually preassembled and upholstered for subsequent assembly into a modular chair 10. Alternatively, means can be provided for securing upholstered trim panels to the frame components following modular assembly of chair body 21.

As previously noted, front frame rail 18 and rear frame rail 20 are adapted to be rigidly secured to side panels 16 for integrally suspending actuation mechanism 12 within a rigid "box-like" chair frame 14. Rear frame rail 28 is a multiple piece structural frame component that is adapted to provide a degree of freedom for permitting adjustment of the side panels 16 but which may be secured together for inhibiting "side-to-side" lateral play of the rear portion of "box-like" chair frame 14. To provide means for securing rear frame rail 20 to side panels 16, the connection brackets 28 disposed on either side of the inter-linking frame rail 26 are securely attached to the side panels 16. Preferably, alignment bores 72 are pre-drilled into side panels 16 for receiving threaded fasteners therein to rigidly secure rear frame rail 20 between the left and right side panels 16. Typically, an upholstered rear "tailgate" (not shown) is mounted to inter-linking frame rail 20 following modular assembly of chair 10.

With continued reference to FIG. 1, seat frame 66 is located between and suspended from reclining movement on side panels 16. Seat frame 66 is supported for movement relative to side panels 16 by means of a rear swing linkage 74 for causing seat frame 66 to move substantially horizontally and slightly up or down, depending on whether seat frame 44 moves forwardly (during "reclining" movement) or rearwardly (on return to the "upright" position). Each rear swing linkage 74 includes an elongated swing link 76.

Seat back frame 68 can be removably mounted on an upper portion of rear swing links 76 by means of slide brackets 78 of seat back 68. A preferred construction of slide brackets 78 for this type of mounting is shown and described in U.S. Pat. No. 5,184,871, assigned to the common assignee of the present invention, the disclosure of which is expressly incorporated by reference herein. In general, slide brackets 78 are channel-shaped to provide an interior track that slidably receives rear swing links 76 therein. When slide brackets 78 are mounted on rear swing links 76, seat back 68 is, in effect, an extension of rear swing links 76. As such, seat back 68 acts as a lever arm for causing relatively easy angularly movement of rear swing links 76 and fore and aft movement of seat 66.

In accordance with the principles of the present invention, the method for assembling the various frame components and actuation mechanism 12 into reclining/rocking chair 10 will now be generally described. The improved method of the present invention permits sequential assembly of the pre-assembled and/or upholstered components in a simple and efficient manner for significantly reducing overall system complexity, weight, and cost while promoting superior quality and reliability. With reference still to FIG. 1, actuation mechanism 12 is initially supported in a spatially-oriented manner on an assembly table or other suitable locating fixture. The various components associated with the actuation mechanism such as the slide brackets, pantograph linkages, drive link, cross-brace, and toggle assemblies are operably coupled to, or suspended from, drive rod 62 and/or front support shaft 64 prior to interconnection with the various chair frame components.

Next, side panels 16 including the rocker blocks, the spring pins, and the rocker spring devices are provided. While not shown, it is to be understood that the requisite padding, lining, decorative upholstery and the like have also been installed on side panels 16 prior to assembly with actuation mechanism 12. Front connection brackets 24*a*, 24*b* and rear connection brackets 28*a*, 28*b* are secured to side panels 16 using threaded fasteners or other similar fastening means. Side panels 16 are then positioned on actuation mechanism 12 such that the opposite ends of drive rod 62 extend through aligned bores formed therein and opposite ends of front support shaft 64 extend through apertures formed in connection brackets 24*a*, 24*b* and aligned bores formed in side panels 16. Front inter-linking rail 22 is loosely secured to front connection brackets 24*a*, 24*b* with threaded fasteners. Rear inter-linking rail 26 is loosely secured to rear connection brackets 28*a*, 28*b*. However, threaded fasteners 42 have not been tightened such that a sufficient degree of movement between side panels 16 exists for achieving proper alignment thereof. Seat 66 is then operably coupled to chair frame 14. More specifically, a front portion of seat 66 is secured to the slide brackets of actuation mechanism 12 and a rear portion of seat 66 is secured to side panels 16 through rear swing linkages 74.

At this point, a substantially complete chair frame with the exception of the removable seat back 68 has been assembled but not aligned. To obtain a square and true chair frame, it is necessary to precisely locate side panels 16 with respect to one another and with respect to the other components of reclining chair 10. To this end, side panels 16 are precisely located in space using four points defined thereon. In a preferred method of assembly, the assembly table or locating fixture engages four contact point defined on the inner surfaces of side panels 16 is provided. Specifically, contact points $X_1$, $X_2$, $X_3$ and $X_4$ are used to control the width and angular orientation (or skew) of side panels 16. With side panels 16 appropriately positioned using the locating fixture, the components of chair frame 14 can be rigidly fastened together. As presently preferred, actuation mechanism 12, front frame rail 18 and rear swing linkages 74 are rigidly secure to side panels 16 first. Then, rear frame rail 20, and more specifically threaded fasteners 42, interconnecting rail 26 and brackets 28*a*, 28*b* are rigidly secured to yield a rigid box-like chair frame. The adjustable nature of rear frame rail 20 accommodates various tolerance stack-ups and component misalignment which result from the fabrication of the chair frame using subassemblies and knock-down construction techniques. To ensure proper alignment of chair frame 14, a comparison of the diagonal measurements (i.e. from the front upper corner of one side panel to the rear lower comer of the opposite side panel) provides a quick and relatively accurate indication of alignment.

Figure 7A:
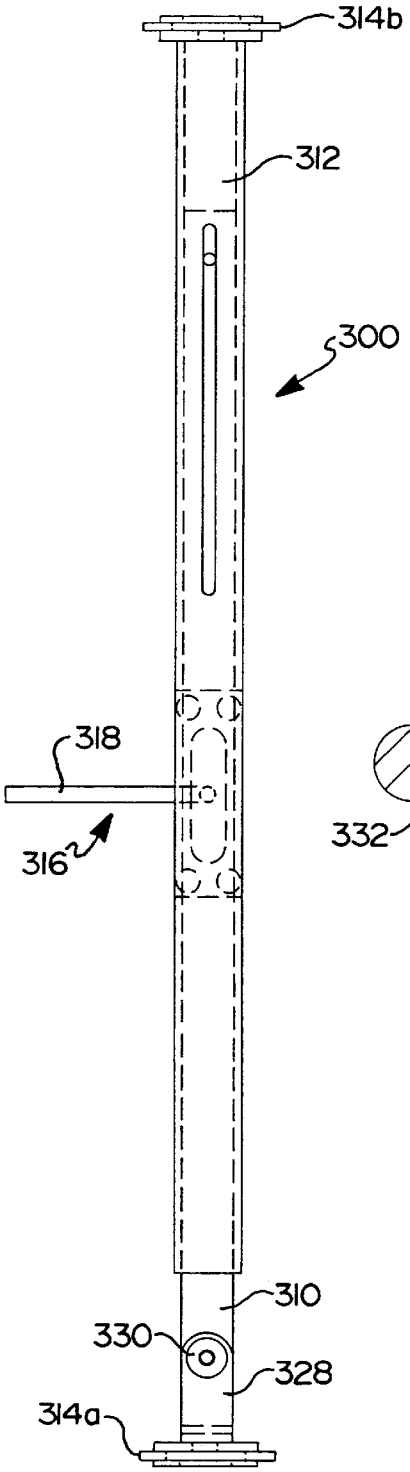
FIGS. 7A through 7C are detailed views of a lockable alignment tool according to the principles of the present invention.
Figure 7B:
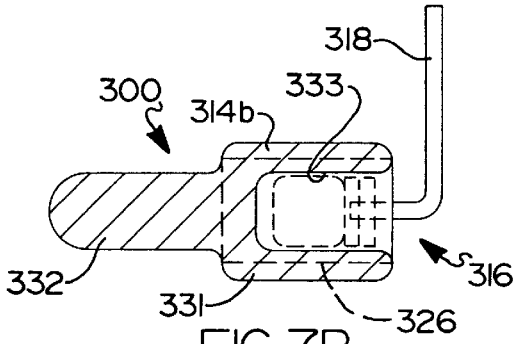
Figure 7C:
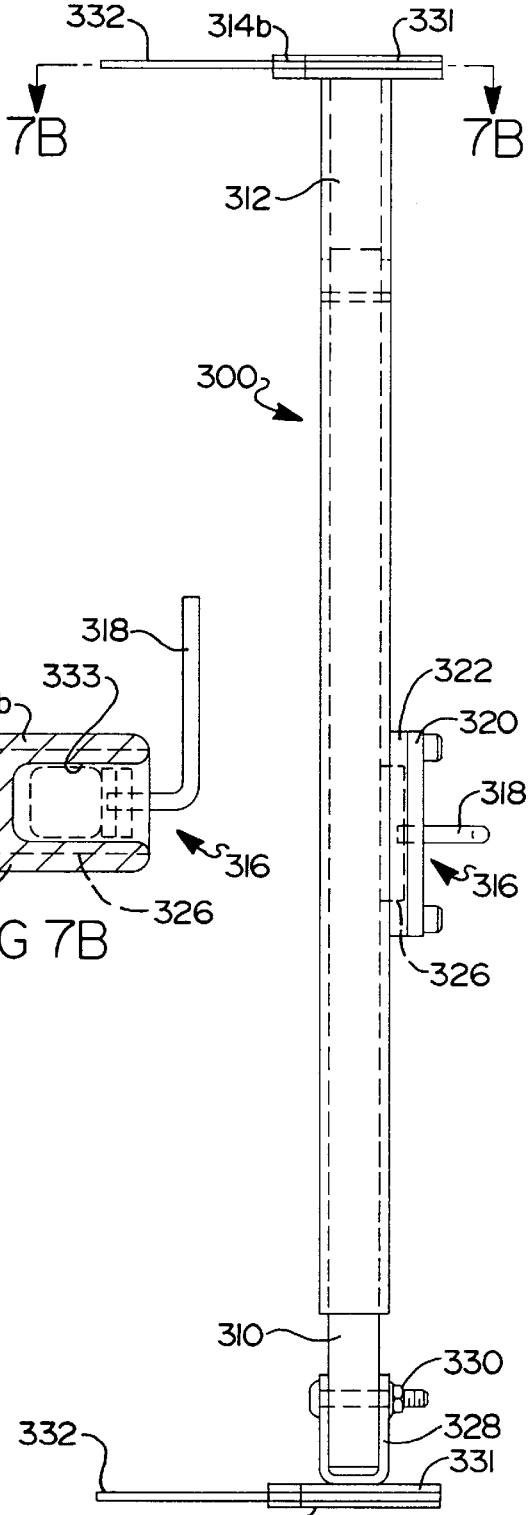

Seat back 68 is provided in the final assembly process and may be releasably secured the the rear swing linkages 74 in a manner heretofore described. Notwithstanding the steps utilized to provide proper alignment of the chair frame, it may be necessary to adjust the alignment of side panels 16 to further insure alignment of seat back slide brackets 78 with rear swing link 76. To facilitate alignment between the seat back frame 46 and chair frame 14, an alignment tool 300 is implemented. With reference to FIGS. 7A–7C, the alignment tool 300 includes a first member 310 slidably interfaced within a second member 312 which defines a cavity for receiving the first member 310 therein. First member 310 is free to slide within second member 312 until a locking mechanism 316 is initiated. Locking mechanism 316 comprises a lock bar 326 which is disposed within a slot of the second member 312 and interfaces with first member 310. A lock mount 322 and cover plate 320 attach to the second member 312, covering the lock bar 326. A lock handle 318 is attached to lock bar 326 and runs through the lock mount 322 and cover plate 320. The lock handle 318 is rotatable in a first and second direction such that the first direction initiates pressed contact between the lock bar 326 and first member 310, therefore inhibiting movement of first member 310 within second member 312. Additionally, the lock handle 318, being rotated in the second direction, releases the movement prohibitive press force between the lock bar 326 and first member 310, such that the first member 310 may be slidable within second member 312.

Disposed on the ends of the first and second members 310, 312 are first and second alignment brackets 314*a* and 314*b*, respectively. Alignment bracket 314*a* is attached to the first member 310 through a clevis bracket 328. The clevis bracket 328 is pivotally attached to the first member 310 by a bolt 330. Additionally, the clevis bracket 328, and therefore the alignment plate 314*a*, can be pivotally rotated about an axis defined by the bolt 330. Alignment plate 314*b* is directly attached to the second member 312. Both alignment plates 314*a*, 314*b* are disposed such that they extend perpendicular to the plane of the first and second members 310, 312. Alignment plates 314*a*, 314*b* comprise a first and second portion, wherein the first portion 331 defines a cavity 333, generally complementary to the shape of the swing link 76 of the chair frame 14 and the second portion 332, generally in the shape of the swing link 76, extends in a parallel plane from the top of the first portion 331. The configuration of the first and second portions 331, 332 is such that the swing links 76 may be received into cavity 333 of the first portion 331 and the slide brackets 78 may receive on the second portion 332.

With reference now to FIGS. 8A and 8B, the alignment process will now be described. To facilitate alignment between the chair frame 14 and seat back 68, alignment tool 300 is introduced after each chair frame 14 and seat back 68 have been independently fabricated. The alignment tool 300, being in its unlocked, slidable state, is implemented such that it is mounted onto the seat back 68 as shown in FIG. 8A. To achieve this, the second portions 332 of alignment plates 314*a* and 314*b* are received into the slide brackets 132 of the seat back 18. As the seat back alignment tool 300 is mounted onto seat back 68, alignment tool 300 is adjusted widthwise. Once alignment tool 300 is fully mounted onto seat back 68, the lock handle 318 is rotated to initiate locking of the alignment tool 300. After locking the alignment tool 300, it is removed from seat back 68. The alignment tool 300 is then mounted onto the chair frame 14 as shown in FIG. 8B. One or more of threaded fasteners 42 may need to be loosened slightly to account for variations in the width of alignment tool 300 as set by seat back 68. The swing links 76 are received into the first portions 331 of alignment plates 314*a*, 314*b*. As the alignment tool 300 is mounted onto the chair frame 14, the interaction between the two properly aligns chair frame 14 with respect to seat back 68. Any misalignment is adjusted such that the alignment tool 300 can be easily mounted. In this manner, the chair frame 14 is now aligned to the seat back 68.

Each of the connection brackets 28*a*, 28*b* of the rear frame member 20 can now be rigidly fixed to the inter-linking frame rail 26, using screws 42 such that the rear frame member 20 becomes a rigid member, linking side panels 16 together. The alignment tool 300 is removed and the assembly process of the reclining chair 10 is completed with proper alignment between the chair frame 14 and seat back 68 ensured.

The foregoing discussion discloses and describes exemplary embodiments of the present invention. One skilled in the art will readily recognize from such discussion, and from the accompanying drawings and claims, that various changes, modifications and variations can be made therein without departing from the spirit and scope of the invention as defined the following claims.

What is claimed is:

1. A reclining chair, comprising:

a chair frame having a pair of side panels;

a seat back attachable to said chair frame; and an adjustable frame rail having a pair of connection brackets secured to said side panels and an inter-linking rail secured to said connection brackets, said adjustable frame rail operable in a first mode to permit relative movement of said pair of side panels for facilitating alignment between said chair frame and said seat back and operable in a second mode to rigidly secure said pair of side panels together, thus enabling said chair frame to be a rigid structure.

2. The reclining chair of claim 1, wherein each of said first and second connection brackets is fixed to said inter-linking rail by first and second fasteners, such that said first and second connecting brackets can be pivotally adjusted to said inter-linking rail about said first fastener and subsequently secured to said inter-connection rail by said second fastener.

3. The reclining chair of claim 1, wherein each of said first and second connection brackets is fixed to said inter-linking rail by first and second fasteners, such that said first and second connecting brackets can be laterally adjusted with respect to said inter-linking rail.

4. The reclining chair of claim 1, wherein at least one of said connection brackets is interfaced with a locking mechanism, said locking mechanism being attached to a bottom face of said interconnecting rail, such that said locking mechanism, in a first mode, allows movement of said at least one connection bracket and in a second mode, is lockable, thus prohibiting movement of said at least one connection bracket.

* * * * *

UNITED STATES PATENT AND TRADEMARK OFFICE

CERTIFICATE OF CORRECTION

PATENT NO. : 6,347,835 B1
DATED : February 19, 2002
INVENTOR(S) : Larry P. LaPointe et al.

It is certified that error appears in the above-identified patent and that said Letters Patent is hereby corrected as shown below:

Column 6,
Line 2, "angularly" should be -- angular --;
Line 53, "point" should be -- points --;
Line 61, "secure" should be -- secured --;

Column 7,
Line 4, "comer" should be -- corner --.

Signed and Sealed this

Twenty-third Day of April, 2002

*Attest:*

*Attesting Officer*

JAMES E. ROGAN
*Director of the United States Patent and Trademark Office*